US008910857B1

(12) United States Patent
Hegarty

(10) Patent No.: US 8,910,857 B1
(45) Date of Patent: Dec. 16, 2014

(54) LAUNDRY BASKET

(71) Applicant: Brian Hegarty, Lagrangeville, NY (US)

(72) Inventor: Brian Hegarty, Lagrangeville, NY (US)

( * ) Notice: Subject to any disclaimer, the term of this patent is extended or adjusted under 35 U.S.C. 154(b) by 0 days.

(21) Appl. No.: 13/933,064

(22) Filed: Jul. 1, 2013

(51) Int. Cl.
*D06F 95/00* (2006.01)

(52) U.S. Cl.
CPC ..... *D06F 95/002* (2013.01)
USPC ..... 232/1 B

(58) Field of Classification Search
USPC ..... 232/1 B; D32/37; D3/216–217; 383/22, 383/36, 66
See application file for complete search history.

(56) References Cited

U.S. PATENT DOCUMENTS

| | | | | |
|---|---|---|---|---|
| 11,898 | A | 11/1854 | Martin | |
| 35,436 | A | 6/1862 | Coombs | |
| 1,500,048 | A | 7/1924 | Bimler | |
| 2,517,757 | A * | 8/1950 | Adlerstein | 312/3 |
| 3,173,464 | A * | 3/1965 | Curtis | 383/22 |
| D312,519 | S | 11/1990 | Hobson | |
| 4,981,232 | A | 1/1991 | Wynn | |
| D327,560 | S | 6/1992 | Hradisky | |
| D343,711 | S | 1/1994 | Craft et al. | |
| 5,287,991 | A | 2/1994 | Koda et al. | |
| 5,421,049 | A | 6/1995 | Hendred | |
| 5,735,608 | A * | 4/1998 | Branco | 383/25 |
| 5,794,810 | A | 8/1998 | Hensley | |
| D409,806 | S | 5/1999 | France | |
| D412,228 | S * | 7/1999 | Diehl | D32/37 |
| D412,229 | S | 7/1999 | Kear | |
| 5,947,314 | A | 9/1999 | Chilewich et al. | |
| 5,964,533 | A | 10/1999 | Ziglar | |
| D416,116 | S | 11/1999 | Sofy | |
| D421,323 | S | 2/2000 | Douglas et al. | |
| 6,212,792 | B1 | 4/2001 | Bier | |
| 6,792,777 | B2 | 9/2004 | Shaw et al. | |
| 6,805,225 | B2 * | 10/2004 | Freedman | 190/112 |
| 7,090,092 | B1 | 8/2006 | Roebuck, Jr. et al. | |
| 7,207,460 | B2 | 4/2007 | Sander et al. | |
| D593,719 | S | 6/2009 | McNamara | |
| 7,677,408 | B2 | 3/2010 | Loucks et al. | |
| D622,466 | S * | 8/2010 | Sabounjian | D32/37 |
| D623,370 | S | 9/2010 | Kuo | |
| D640,435 | S * | 6/2011 | Jensen | D34/4 |
| D699,031 | S * | 2/2014 | Clavette et al. | D3/216 |
| 2003/0168461 | A1 | 9/2003 | Richardson | |
| 2005/0284867 | A1 * | 12/2005 | Sander et al. | 220/23.86 |

(Continued)

FOREIGN PATENT DOCUMENTS

EP 2157232 B1 6/2012

OTHER PUBLICATIONS

Victorian Fireplace Shop, Accessories, Coal Hods [online], [retrieved on Jul. 1, 2013]. Retrieved from the Internet <URL: http://www.gascoals.com/index/ACCESSORIES/coalhods.aspx>.

*Primary Examiner* — William Miller
(74) *Attorney, Agent, or Firm* — Law Offices of Ira D. Blecker, P.C.

(57) ABSTRACT

A laundry basket which includes a main body and a chute that extends from, and away from, the main body. The main body has an enclosing side portion and an end portion, the enclosing side portion and end portion cooperating to form an enclosure having an open end and a closed end defined by the end portion. The main body is totally enclosed by the enclosing side portion except for a slit in the enclosing side portion that extends from the open end towards the closed end of the main body.

16 Claims, 4 Drawing Sheets

(56) References Cited

U.S. PATENT DOCUMENTS

2006/0208439 A1* 9/2006 Depasquale et al. ..... 280/47.17
2009/0321434 A1* 12/2009 Rothschild et al. ..... 220/6
2011/0094902 A1 4/2011 Delehey et al.
2013/0043258 A1* 2/2013 Cerri, III ..... 220/660
2013/0062357 A1* 3/2013 Souza ..... 220/676

* cited by examiner

LAUNDRY BASKET

BACKGROUND

The exemplary embodiments relate to a laundry basket and, more particularly, relate to a laundry basket having a dispensing chute for dispensing clothing articles from the laundry basket into, for example, a washing machine or dryer.

Current laundry baskets tend to be rectangular or round baskets which hold clothes needing to be laundered. These current laundry baskets may need to be placed on the floor or a surface immediately in front of a washing machine or dryer.

The clothing articles must then be lifted up into the washing machine or dryer from the laundry basket which may be an uncomfortable process for some individuals. The current laundry baskets do not facilitate the loading of clothing articles into a washing machine or dryer.

BRIEF SUMMARY

The various advantages and purposes of the exemplary embodiments as described above and hereafter are achieved by providing, according to a first aspect of the exemplary embodiments, a laundry basket which includes a main body and a chute that extends from, and away from, the main body. The main body has an enclosing side portion and an end portion, the enclosing side portion and end portion cooperating to form an enclosure having an open end and a closed end defined by the end portion. The main body is totally enclosed by the enclosing side portion except for a slit in the enclosing side portion that extends from the open end towards the closed end of the main body.

According to a second aspect of the exemplary embodiments, there is provided a laundry basket which includes a main body having an enclosing side portion and an end portion, the enclosing side portion and end portion cooperating to form an enclosure having an open end and a closed end defined by the end portion, the main body further comprising a slit in the enclosing side portion that extends from the open end towards the closed end of the main body; and a chute integral with the side portion and extending from, and away from, the open end of the main body.

BRIEF DESCRIPTION OF SEVERAL VIEWS OF THE DRAWINGS

The features of the exemplary embodiments believed to be novel and the elements characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION

Figure 1:
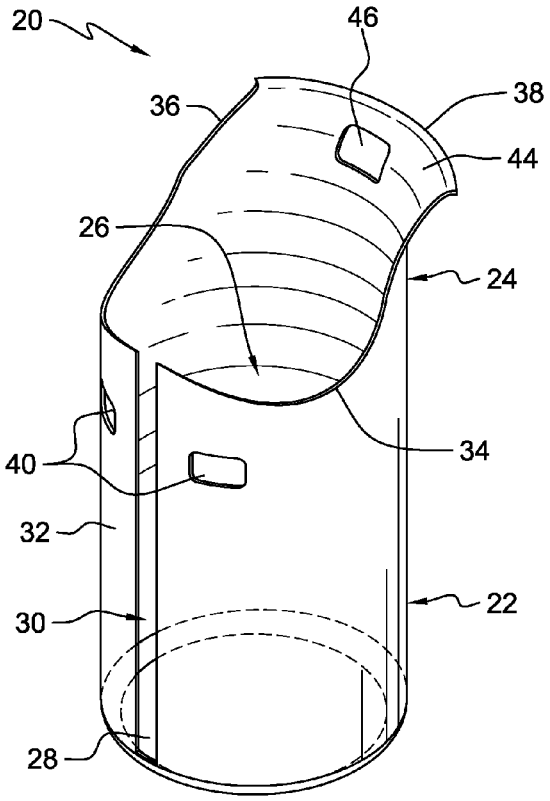
FIG. 1 is a perspective view of a first exemplary embodiment of the laundry basket.

A conventional laundry basket is made to hold clothing items but when it comes time to unload the clothing items, a user must reach down and lift the laundry items from the laundry basket and place the clothing items in a washing machine or dryer.

The exemplary embodiments are substantially different in that the user may simply lift the laundry basket and essentially "pour" the clothing items from the laundry basket into the washing machine or dryer. The exemplary embodiments are further improved by having a slit in the side of the laundry basket so that a user may place his/her hand through the slit and manually push the clothes out from the laundry basket and into the washing machine or dryer. The exemplary embodiments of the laundry basket may also be nested for convenient storage.

Referring to the Figures in more detail, and particularly referring to FIGS. 1 to 4, there is illustrated a first exemplary embodiment of a laundry basket 20. The laundry basket 20 includes a main body 22 and a chute 24. The main body 22 includes a side portion 32 which substantially encloses the space 26 within the laundry basket 20 and an end portion 28, partially shown in phantom. The main body 22 further includes a slit 30 in the side portion 32. It should be understood that when it is stated that the side portion 32 substantially encloses the space 26 within the laundry basket 20, it is meant that the side portion 32 encloses the space 26 except for the opening caused by the slit 30.

The end portion 28 closes off the main body 22 at one end. The other end 34 of the main body 22 is open. The slit 30 extends from the open end 34 of the main body towards the end portion 28 and, most preferably, extends entirely from the open end 34 to the end portion 28. The slit should have a width sufficient for a user's hand to comfortably pass through the slit 30 without chafing the user's hand. For purposes of illustration and not limitation, the width may be 3 to 5 inches. In addition, the side portion 32 may have some flexibility so that when a user places his/her hand in the slit 30, the slit 30 may expand so that the user's hand may comfortably pass through the slit 30. In this latter instance when the side portion 32 may have some flexibility, the width of the slit may be just 1 to 3 inches.

Figure 4:
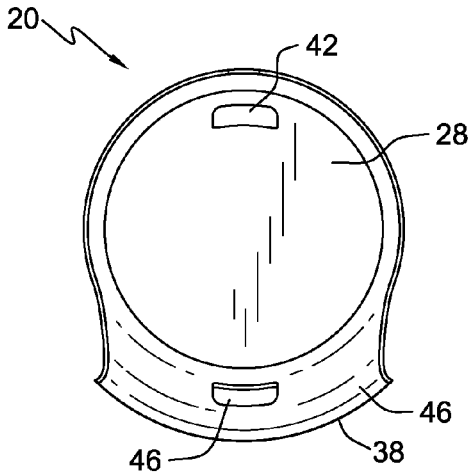
FIG. 4 is an end perspective view of the first exemplary embodiment of the laundry basket.

As noted earlier, the laundry basket 20 includes a chute 24. For added strength and functionality, the chute 24 may be integrally formed with the main body 22. The chute 24 preferably has sides 36 which gradually decrease in size as the end 38 of the chute 24 is reached. The chute 24 has a curvature (best seen in FIG. 4) which generally matches the curvature of the end portion 28 of the main body. It is preferred that the chute 24 be disposed so that it is opposite the slit 30 (as best seen in FIG. 4).

Figure 2:
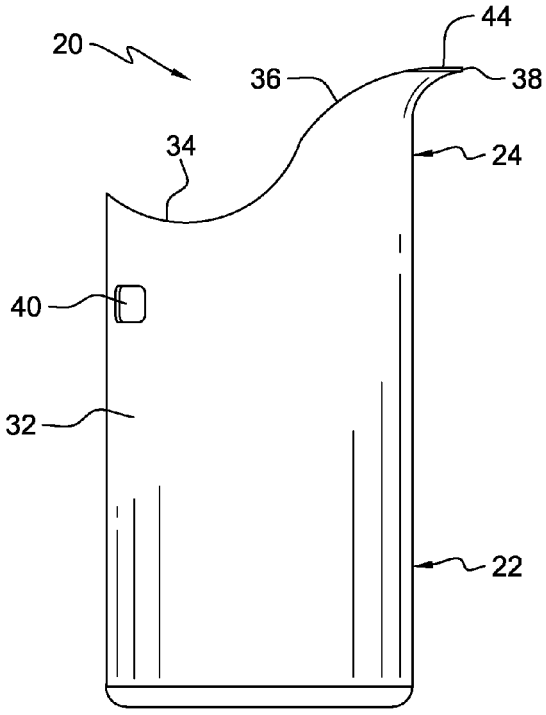
FIG. 2 is a side view of the first exemplary embodiment of the laundry basket.

For ease of handling the laundry basket, the side portion 32 may have one of more handles 40 formed in or added to the side portion 32. The end portion 28 in addition may have a handle 42 (as best seen in FIG. 4) formed in or added to the end portion 28. The chute 24 may have an edge portion 44 (as best seen in FIG. 2) which extends away from the chute 24. Within the edge portion 44, or added to it, may be another handle 46.

Figure 3:
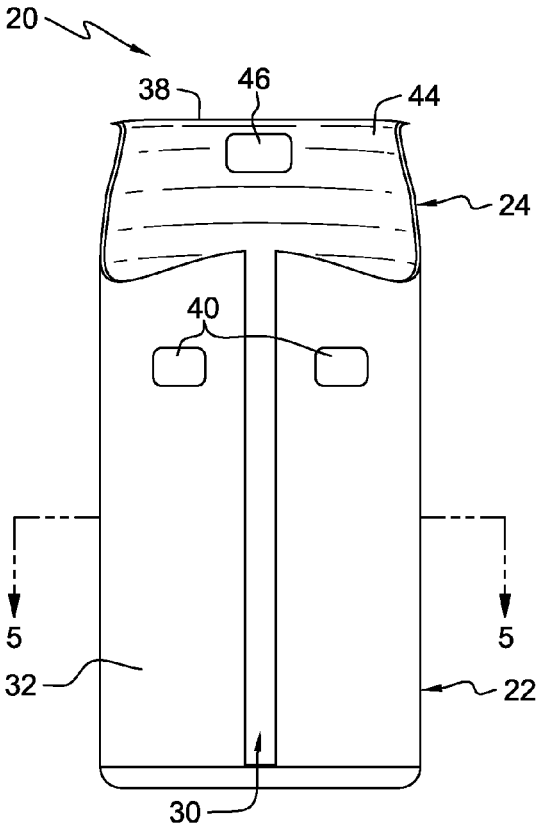
FIG. 3 is a top view of the first exemplary embodiment of the laundry basket.
Figure 5:
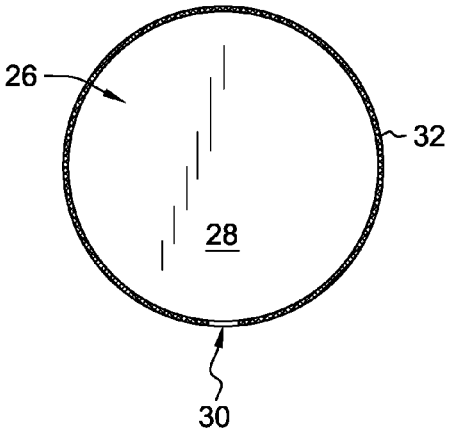
FIG. 5 is a cross sectional view of the first exemplary embodiment of the laundry basket of FIG. 3 in the direction of arrows 5-5.

FIG. 5 is a cross sectional view of FIG. 3 in the direction of arrows 5-5. It can be seen that the side portion 32 has a circular cross section which encloses the space 26 except for slit 30 in the side portion 32.

Figure 6:
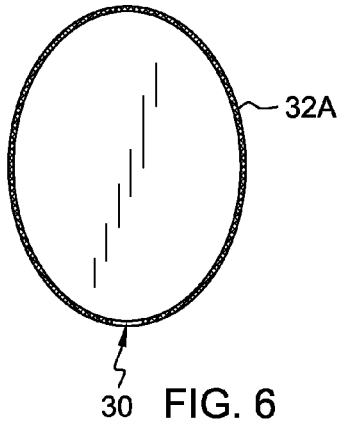
FIG. 6 is a cross sectional view similar to FIG. 5 showing a second exemplary embodiment of the laundry basket.
Figure 7:
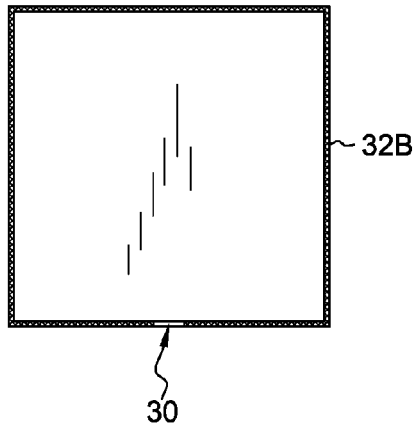
FIG. 7 is a cross sectional view similar to FIG. 5 showing a third exemplary embodiment of the laundry basket.

The side portion 32 may alternatively have an oval cross section such as side portion 32A in FIG. 6 or a rectangular cross section such as side portion 32B in FIG. 7.

The laundry basket 20 may be conveniently made by injection molding but other manufacturing processes may be used as well. The laundry basket 20 may be made from any suitable material such as a plastic or polymeric material.

In use, the user may open the door of the washing machine or dryer and place the edge portion 44 of the chute 24 on the edge of, or in, the washing machine or dryer. The user may then tilt the end portion 28 up using anyone of the handles 40 or 42 and place a hand within the slit 30 and slide toward the edge portion 44 to push the clothing articles within the laundry basket 20 down the chute 24 and into the washing machine or dryer.

In addition to using a user's hand to assist in the unloading of the clothing articles, the laundry basket 20 may further include a sliding member (not shown) or secondary bottom (not shown) which may be moved to push the clothing articles from the laundry basket 20. The sliding member or secondary bottom may cooperate with the slit 30.

Figure 8:
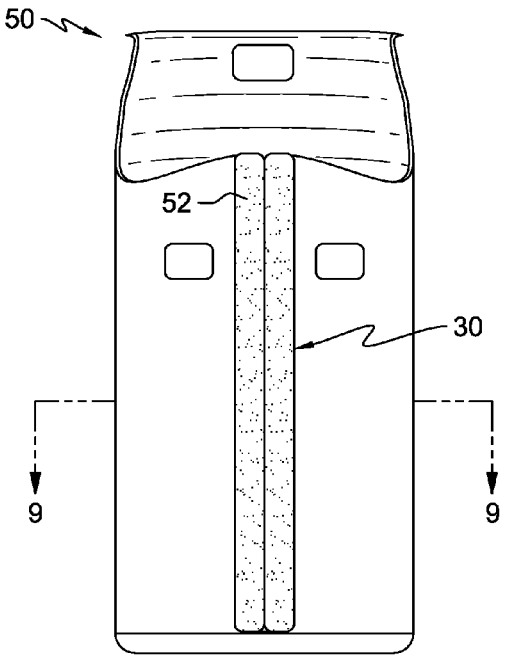
FIG. 8 is a top view of a first modification of the first exemplary embodiment of the laundry basket.

Referring now to FIG. 8, the laundry basket 20 of FIGS. 1 to 4, now referred to as laundry basket 50, has been modified by adding a soft material 52 within the slit 30. The soft material 52, may be, for purposes of illustration and not limitation, a foam rubber. The soft material 52 may serve the dual purpose of covering the slit 30 to prevent small clothing articles from falling through the slit 30 and to protect the user's hand while passing through the slit 30.

Figure 9:
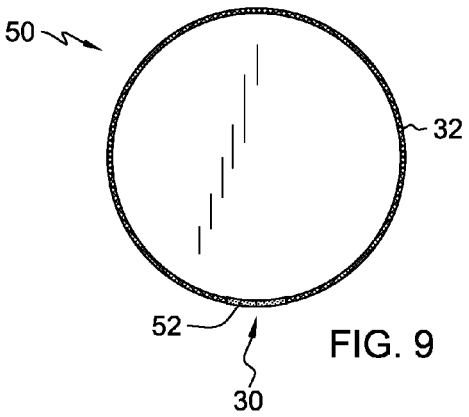
FIG. 9 is a cross sectional view of the exemplary embodiment of the laundry basket of FIG. 8 in the direction of arrows 9-9.

FIG. 9 is a cross sectional view of FIG. 8 in the direction of arrows 9-9 showing the soft material 52. The soft material 52 may be formed integrally with the side portion 32 (as shown in FIG. 9) or may be added to it later by adhering strips of soft material to the side portion 32, such as by an adhesive or mechanical fasteners.

Figure 10:
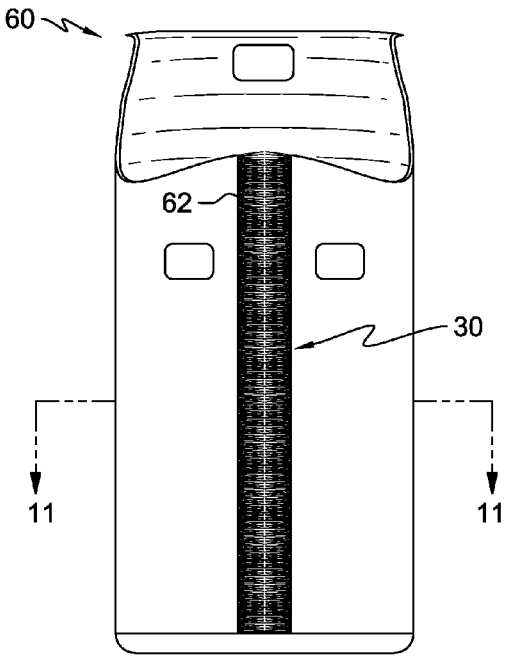
FIG. 10 is a top view of a second modification of the first exemplary embodiment of the laundry basket.

Referring now to FIG. 10, the laundry basket 20 of FIGS. 1 to 4, now referred to as laundry basket 60, has been modified by adding a flexible material 62 within the slit 30. The flexible material 62, may be, for purposes of illustration and not limitation, soft brushes. The flexible material 62 may serve the dual purpose of covering the slit 30 to prevent small clothing articles from falling through the slit 30 and to protect the user's hand while passing through the slit 30.

Figure 11:
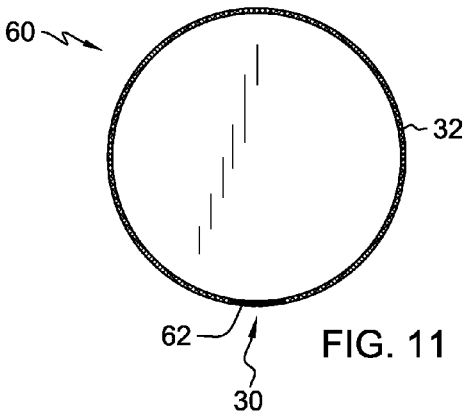
FIG. 11 is a cross sectional view of the exemplary embodiment of the laundry basket of FIG. 10 in the direction of arrows 11-11.

FIG. 11 is a cross sectional view of FIG. 10 in the direction of arrows 11-11 showing the flexible material 62. The flexible material 62 may be formed integrally with the side portion 32 (as shown in FIG. 11) or may be added to it later by adhering strips of brush material to the side portion 32, such as by an adhesive or mechanical fasteners.

Figure 12:
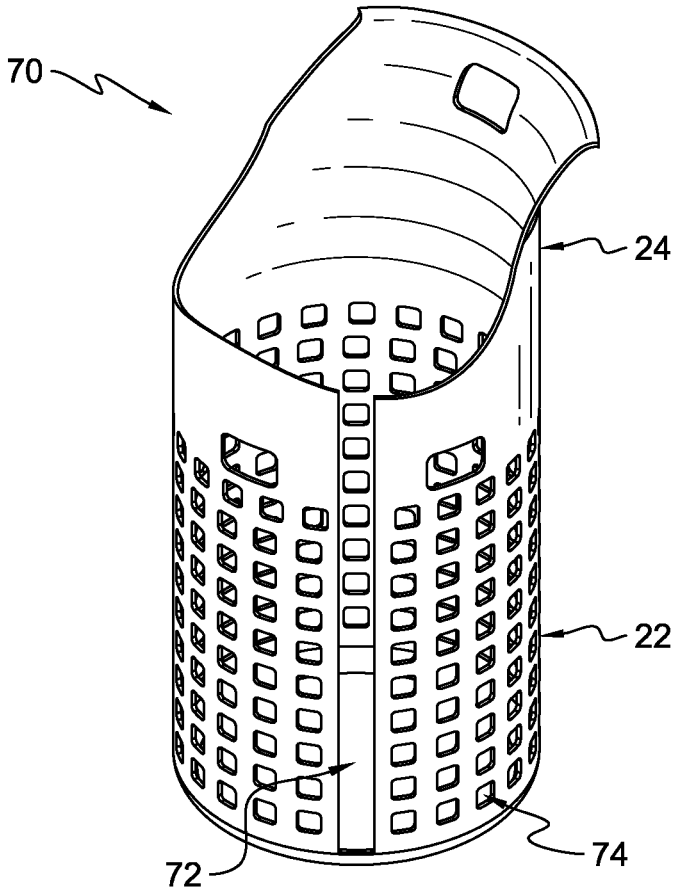
FIG. 12 is a perspective view of a fourth exemplary embodiment of the laundry basket.

Referring now to FIG. 12, there is shown yet another exemplary embodiment. Laundry basket 70 shown in FIG. 12 is similar to the laundry basket shown in FIGS. 1 to 4 except that laundry basket 70 has a slit 72 which is not opposite the chute 24.

Also shown in FIG. 12 are perforations 74 in the laundry basket 70. Perforations 74 may serve the purpose of ventilation to allow airflow through the laundry basket 70 to remove odors. Perforations 74 may also serve to reduce the weight of the laundry basket 70. Perforations 74 are shown only on the main body 22 of the laundry basket 70 but may also be placed on the chute 24 if desired. It should be understood that while perforations 74 are only shown on the exemplary embodiment 70 in FIG. 12, perforations may be used in any of the exemplary embodiments.

It will be apparent to those skilled in the art having regard to this disclosure that other modifications of the exemplary embodiments beyond those embodiments specifically described here may be made without departing from the spirit of the invention. Accordingly, such modifications are considered within the scope of the invention as limited solely by the appended claims.

What is claimed is:

1. A laundry basket comprising:

a main body and an integrally formed chute that extends from, and away from, the main body, the chute being in fixed relation to the main body;

the main body having an enclosing tubular side portion and an end portion attached to the enclosing tubular side portion, the enclosing tubular side portion and end portion cooperating to form an enclosure having an open end of a fixed dimension and a closed end defined by the end portion, the enclosure being totally surrounded by the enclosing tubular side portion except for a slit of a fixed dimension in the enclosing tubular side portion substantially diametrically opposed to the chute that extends continuously through and from the open end to the closed end of the enclosure.

2. The laundry basket of claim 1 wherein the main body is circular in cross section.

3. The laundry basket of claim 1 wherein the main body is oval in cross section.

4. The laundry basket of claim 1 wherein the main body is rectangular in cross section.

5. The laundry basket of claim 1 further comprising a handle in the end portion and a handle portion in the side portion.

6. The laundry basket of claim 1 further comprising a soft material attached to the enclosing tubular side portion and contained within the slit so as to fill the slit.

7. The laundry basket of claim 1 further comprising a flexible material attached to the enclosing tubular side portion and contained within the slit so as to fill the slit.

8. The laundry basket of claim 1 further comprising a plurality of perforations in the main body.

9. A laundry basket comprising:

a main body having an enclosing tubular side portion and an end portion attached to the enclosing tubular side portion, the enclosing side portion and end portion cooperating to form an enclosure having an open end of a fixed dimension and a closed end defined by the end portion, the enclosure being totally surrounded by the enclosing tubular side portion except for a slit in the enclosing tubular side portion, the slit in the enclosing tubular side portion being of a fixed dimension and extends continuously through and from the open end to the closed end of the enclosure; and a chute integrally formed with and in fixed relation to the enclosing tubular side portion and extending from, and away from, the open end of the enclosure, the slit being substantially diametrically opposed to the chute.

10. The laundry basket of claim 9 wherein the main body is circular in cross section.

11. The laundry basket of claim 9 wherein the main body is oval in cross section.

12. The laundry basket of claim 9 wherein the main body is rectangular in cross section.

13. The laundry basket of claim 9 further comprising a handle in the end portion and a handle in the side portion.

14. The laundry basket of claim 9 further comprising a soft material attached to the enclosing tubular side portion and contained within the slit so as to fill the slit.

15. The laundry basket of claim 9 further comprising a flexible material attached to the enclosing tubular side portion and contained within the slit so as to fill the slit.

16. The laundry basket of claim 9 further comprising a plurality of perforations in the main body.

* * * * *